US008049422B2

(12) United States Patent
Tsuda et al.

(10) Patent No.: US 8,049,422 B2
(45) Date of Patent: Nov. 1, 2011

(54) ELECTRIC DISCHARGE LAMP HAVING CERAMIC LUMINOUS TUBE

(75) Inventors: Toshiaki Tsuda, Shizuoka (JP); Yukihiro Onoda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 254 days.

(21) Appl. No.: 12/276,502

(22) Filed: Nov. 24, 2008

(65) Prior Publication Data

US 2009/0134792 A1 May 28, 2009

(30) Foreign Application Priority Data

Nov. 28, 2007 (JP) ..... 2007-307180

(51) Int. Cl.

| | |
|---|---|
| ***H01J 11/00*** | (2006.01) |
| ***H01J 17/00*** | (2006.01) |
| ***H01J 17/20*** | (2006.01) |
| ***H01J 61/12*** | (2006.01) |

(52) U.S. Cl. ..... 313/568; 313/567; 313/569; 313/637

(58) Field of Classification Search ..... None
See application file for complete search history.

(56) References Cited

U.S. PATENT DOCUMENTS

| | | | | |
|---|---|---|---|---|
| 5,159,239 | A * | 10/1992 | Ekkelboom et al. | 313/623 |
| 5,552,670 | A * | 9/1996 | Heider et al. | 313/625 |
| 6,495,962 | B2 * | 12/2002 | Uemura et al. | 315/77 |
| 6,534,917 | B1 * | 3/2003 | Kira | 313/623 |
| 6,538,383 | B1 * | 3/2003 | Takeuchi | 313/637 |
| 2004/0108814 | A1 * | 6/2004 | Tsuda et al. | 313/634 |
| 2008/0211411 | A1 * | 9/2008 | Uemura et al. | 313/634 |

FOREIGN PATENT DOCUMENTS

JP 2004-103461 A 4/2004

* cited by examiner

*Primary Examiner* — Natalie Walford
(74) *Attorney, Agent, or Firm* — Sughrue Mion, PLLC

(57) ABSTRACT

An electric discharge lamp has a ceramic luminous tube 5 and filled with xenon gas, a pair of electrodes 9, 10 held by the ceramic luminous tube, and a glass outer tube 6 accommodating the ceramic luminous tube and the pair of electrodes. The ceramic luminous tube includes a luminous portion 7 emitting light by electric discharge, and a pair of small diameter tube portions 8, 8 respectively connected to both end portions of the luminous portion in a longitudinal direction. Value of P/(r•t) is not less than 4.8 and not more than 32, where P (atm) is pressure of xenon gas filled into the ceramic luminous tube, r (mm) is an inner diameter of the luminous portion of the ceramic luminous tube, and t (mm) is thickness of the luminous portion of the ceramic luminous tube.

2 Claims, 1 Drawing Sheet

ELECTRIC DISCHARGE LAMP HAVING CERAMIC LUMINOUS TUBE

BACKGROUND OF THE INVENTION

1. Field of the Invention

Apparatuses and devices consistent with the present invention relate to an electric discharge lamp and, more particularly, to an electric discharge lamp including a ceramic luminous tube.

2. Description of the Related Art

For example, in a related art headlight for a vehicle, an incandescent lamp (incandescent bulb), a halogen lamp (halogen bulb) or an electric discharge lamp (electric discharge bulb) is used for the luminous source.

In a headlight using an incandescent lamp or a halogen lamp for the luminous source, a filament of the incandescent lamp or the halogen lamp forms a rod-shaped luminous portion and is substantially uniformly luminous. Accordingly, when the incandescent lamp or the halogen lamp is used in a reflection type lighting device, which includes a reflector, a light distribution control can be executed by changing a shape of a reflecting face of the reflector.

On the other hand, in a related art headlight having an electric discharge lamp, since a quantity of light of the electric discharge lamp is larger than that of the incandescent lamp or the halogen lamp, the luminance can be enhanced. Further, the life of the electric discharge lamp is longer than that of the incandescent lamp or the halogen lamp.

As described above, the luminance of the electric discharge lamp is higher than that of the incandescent lamp or the halogen lamp and the life of the electric discharge lamp is longer than that of the incandescent lamp or the halogen lamp. Thus, headlights including the electric discharge lamp have come into wide use recently.

Concerning the related art electric discharge lamp, a luminous tube made of glass is used. A pair of electrodes are held in the luminous tube and a rare gas is filled in the luminous tube. However, metallic halide filled in the luminous tube tends to corrode the luminous tube made of glass. Accordingly, blackening or devitrification is caused, and it becomes difficult to obtain a proper light distribution. Further, as the corrosion increases, the life of the electric discharge lamp is shortened.

Thus, a related art electric discharge lamp has been proposed which has a luminous tube made of ceramics instead of the glass luminous tube. For example, Japanese Patent Unexamined Publication JP-A-2004-103461 describes a related art electric discharge lamp including a ceramic luminous tube.

In the related electric discharge lamp described in the JP-A-2004-103461, a pair of electrodes are held by the ceramic luminous tube and a hermetic space is formed in the ceramic luminous tube. The hermetic space formed in the ceramic luminous tube is filled with rare gas such as xenon gas and metallic halide. The ceramic luminous tube is covered with an outer tube made of glass and the hermetic space is also formed between the ceramic luminous tube and the outer tube.

Since the ceramic luminous tube is stable with respect to metallic halide, the life of the electric discharge lamp described above is advantageously longer than that of the electric discharge lamp having a glass luminous tube.

However, there are also a number of disadvantages. For example, in the electric discharge lamp, at a time of electrical discharge, a so-called arc-bend is generated in which a central portion of an arc generated between a pair of electrodes is bent upward. Accordingly, a temperature of an upper portion of the luminous tube becomes higher than a temperature of other portions.

When the temperature of the upper portion of the luminous tube becomes higher than the temperatures of the other portions, there is a possibility of generating cracks in the luminous tube by thermal stress depending upon the heat resistance and the thermal shock property of the luminous tube.

Since it is known that by lowering the pressure of the rare gas, such as xenon gas filled in the luminous tube, the arc-bend is suppressed, it has been considered to decrease the pressure of the rare gas in order to suppress the generation of arc-bend. However, when the pressure of rare gas is decreased, a disadvantage results in that the luminous efficiency is deteriorated.

SUMMARY OF THE INVENTION

Exemplary embodiments of the present invention address the above disadvantages and other disadvantages not described above. However, the present invention is not required to overcome the disadvantages described above, and thus, an exemplary embodiment of the present invention may not overcome any of the disadvantages described above.

In view of the above, it is an aspect of the present invention is to enhance the durability and the luminous efficiency of the electric discharge lamp.

According to an exemplary embodiment of the present invention, there is provided an electric discharge lamp comprising a ceramic luminous tube comprising a luminous portion filled with xenon gas and emitting light; and two tube portions connected respectively to longitudinal end portions of the luminous portion, an outer diameter of each of the tube portions being smaller than an outer diameter of the luminous portion. The electric discharge lamp further comprises two electrodes held by the tube portions, respectively; and a glass outer tube which accommodates the ceramic luminous tube and the two electrodes therein, and a value of $P/(r \cdot t)$ is not less than 4.8 and not more than 32, in which P (atm) denotes a pressure of the xenon gas filled in the luminous portion, r (mm) denotes an inner diameter of the luminous portion, and t (mm) denotes wall thickness of the luminous portion.

Accordingly, in the electric discharge lamp, it is possible to increase a quantity of luminous flux and to reduce the thermal stress.

According to another exemplary embodiment of the invention, there is provided an electric discharge lamp comprising a ceramic luminous tube comprising a luminous portion filled with xenon gas and emitting light; and two tube portions respectively connected to longitudinal end portions of the luminous portion, an outer diameter of each tube portion being smaller than an outer diameter of the luminous portion. The electric discharge lamp further comprises two electrodes held by the tube portions, respectively; and a glass outer tube which accommodates the ceramic luminous tube and the two electrodes therein, and a value of $R \cdot P/r$ is not less than 60 and not more than 640, in which P (atm) denotes a pressure ofxenon gas filled in the luminous portion, r (mm) denotes an inner diameter of the luminous portion and R (W/(m•K)) denotes a coefficient of thermal conductivity of the ceramic luminous tube.

Accordingly, in the electric discharge lamp, it is possible to increase a quantity of luminous flux and to reduce the thermal stress.

DETAILED DESCRIPTION OF EXEMPLARY EMBODIMENTS OF THE PRESENT INVENTION

Figure 1:
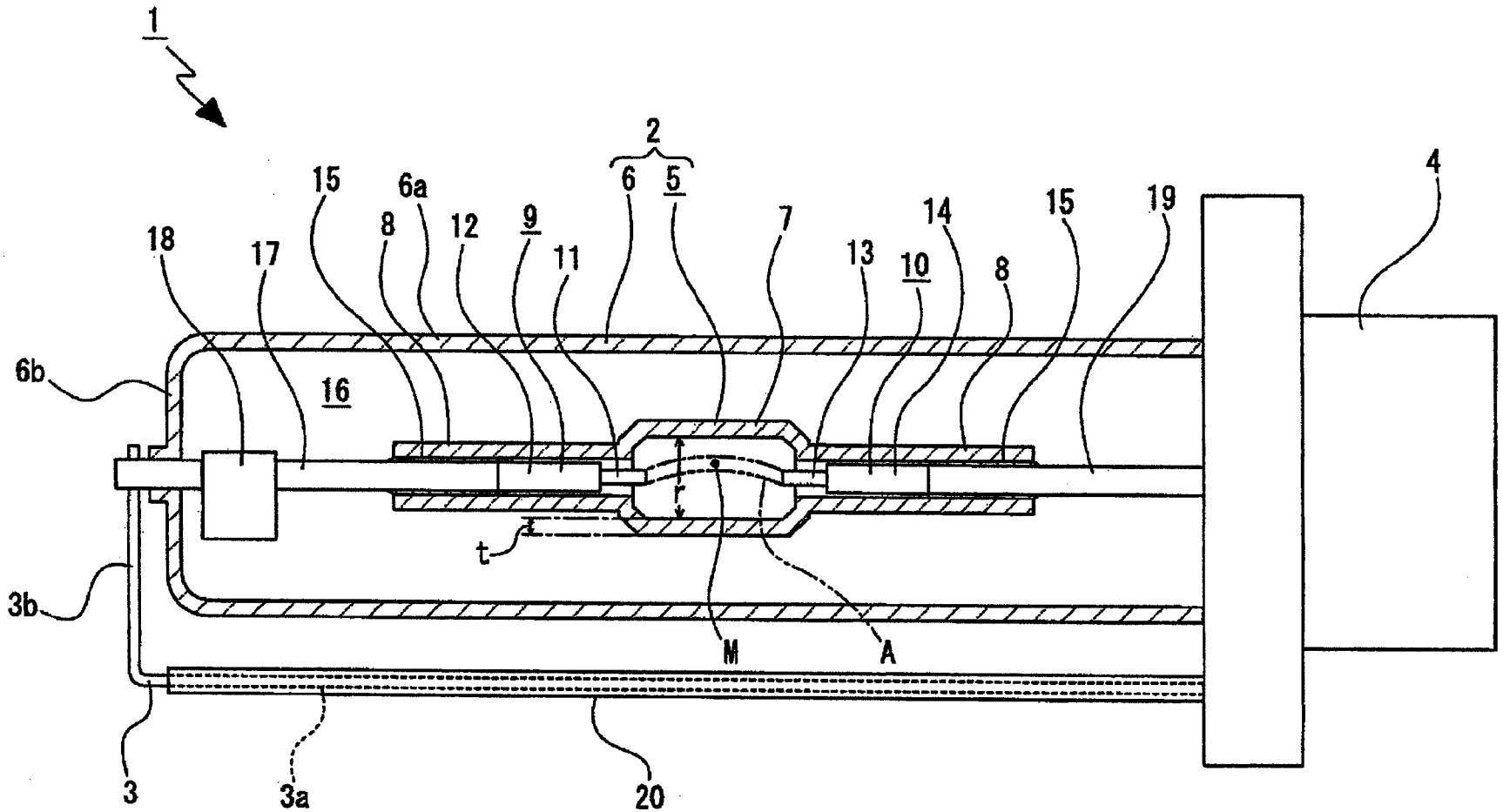
FIG. 1 is a view showing an outline of a headlight according to an exemplary embodiment of the present invention.

Referring to the accompanying drawing, an exemplary embodiment of the present invention will be explained below.

The electric discharge lamp (electric discharge lamp) 1 is provided in a headlight for a vehicle.

The electric discharge lamp 1 has a main body 2 and an external lead wire 3 both of which are connected to a socket 4 as shown in FIG. 1.

The main body 2 includes a ceramic luminous tube 5 and an outer tube 6 for covering the ceramic luminous tube 5.

The ceramic luminous tube 5 is made of ceramics and includes a luminous portion 7 and a plurality of small diameter tube portions 8, 8 respectively connected to end portions in a longitudinal direction of the luminous portion 7. The luminous portion 7 and the small diameter tube portions 8, 8 are integrated with each other into one body. The luminous portion 7 and the small diameter tube portions 8, 8 are respectively formed into substantially cylindrical shapes extending in the longitudinal direction. Outer diameters of the small diameter portions 8, 8 are smaller than the outer diameter of the luminous portion 7.

Metallic halide and Xenon gas, which is a rare gas, are charged into the luminous portion 7.

The small diameter portions 8, 8 respectively hold a front side electrode 9 and a rear side electrode 10 which extends in the longitudinal direction.

The front side electrode 9 includes an electric discharge electrode portion 11 and a connecting electrode portion 12 joined to a front end portion of the electric discharge electrode portion 11. The electric discharge electrode portion 11 is made of, for example, tungsten and the connecting electrode portion 12 made of, for example, molybdenum.

The rear side electrode 10 includes an electric discharge electrode portion 13; and a connecting electrode portion 14 joined to a rear end portion of the electric discharge electrode portion 13. The electric discharge electrode portion 13 is made of, for example, tungsten and the connecting electrode portion 14 is made of, for example, molybdenum.

In the front side electrode 9 and the rear side electrode 10, the connecting electrode portions 12, 14 are respectively joined to the small diameter portions 8, 8 of the ceramic luminous portion 5 using a frit glass 15, 15. When the front side electrode 9 and the rear side electrode 10 are respectively joined to the small diameter portions 8, 8 using the frit glass 15, 15, a hermetic space is formed in the ceramic luminous tube 5.

The outer tube 6 comprises a cylindrical portion 6*a*, which is formed into a substantially cylindrical shape, and a sealing portion 6*b*, which seals an opening on the front side of the cylindrical portion 6*a*. The cylindrical portion 6*a* and the sealing portion 6*b* are formed as one quartz glass body. Interior of the outer tube 6 forms an accommodating space 16.

A first lead wire 17 extending in the longitudinal direction is connected to the front side electrode 9. A rear end portion of the first lead wire 17 is joined to the front side electrode 9 and a front end portion of the first lead wire 17 protrudes forward from the sealing portion 6*b* of the outer tube 6.

A getter 18 which is attached to the first lead wire 17 is arranged in the accommodating space 16. The getter 18 absorbs impurities that which exist in the accommodating space 16 so as to enhance the luminous efficiency.

A second lead wire 19 extending in the longitudinal direction is connected to the rear side electrode 10. A front end portion of the second lead wire 19 is joined to the rear side electrode 10 and a rear end portion of the second lead wire 19 is connected to a first connection terminal (not shown) provided in the socket 4.

The first lead wire 17 is connected to an external lead wire 3. The external lead wire 3 includes a horizontal portion 3*a* extending in the longitudinal direction; and a vertical portion 3*b* which is bent upward from the front end portion of the horizontal portion 3*a* and extended in a vertical direction. An upper end portion of the vertical portion 3*b* of the external lead wire 3 is connected to a front end portion of the first lead wire 17 and a rear end portion of the horizontal portion 3*a* of the external lead wire 3 is connected to a second connection terminal (not shown) provided in the socket 4.

The horizontal portion 3*a* of the external lead wire 3 is attached with an insulation sleeve 20. The insulation sleeve 20 is made of insulation material such as glass or ceramics.

The electric discharge lamp 1 is arranged in a headlight for a vehicle so that the socket 4 is attached to a reflector (not shown) provided in the headlight.

Description of Experimental Data

Fourteen samples of electric discharge lamps configured as described above were tested. A first measurement and a second measurement, which were made for each electric discharge lamp 1, will be explained below.

The first measurement will be explained as follows, referring to Tables 1 to 3.

In the first measurement, P/(r•t) was calculated for each of the fourteen sample electric discharge lamps. Here, P (atm) denotes a pressure in atoms of xenon gas charged into the ceramic luminous tube 5, r (mm) denotes an inner diameter in millimeters of the luminous portion 7 of the ceramic luminous tube 5 as shown in FIG. 1, and t (mm) denotes a thickness in millimeters of the luminous portion 7 of the ceramic luminous tube 5 as shown in FIG. 1.

Then, the luminous flux (lm) emergent from the luminous portion 7, the durable time in hours (h) of the ceramic luminous tube 5 and the maximum value (nt) of the luminance were measured for the respective values. From the measured luminous flux, the luminous efficiency (1 m/W) was calculated.

The luminous efficiency was calculated by "Luminous flux/Electric power". In the first measurement, the electric power was 25 W (±5 W) used for the electric discharge lamp 1. Accordingly, the luminous efficiency was calculated by "Luminous flux/25".

The luminance of the central portion (M shown in FIG. 1) of the arc A (shown in FIG. 1) was measured as the maximum value.

In the first measurement, a luminous efficiency of not less than 120 (1 m/W), an endurance time of not less than 2500 (h) and a maximum value of the luminance of not less than 100 (nt) were set as first target values.

Further, a luminous efficiency of not less than 130 ($l_m$/W), an endurance time of not less than 3000 (h) and a maximum value of the luminance of not less than 120 (nt) were set as second target values.

In Tables 1 to 3, values attached with the reference mark "*" are values that attained the first target values and values attached with the reference mark "**" are values that attained the second target values.

The results obtained in the first measurement were compared with the first and the second target values. A determination was made using five stages A, B, C, D and E, in which A is the best and E is the worst.

The first measurement was made in the ranges of the pressure P=8 to 32 of xenon gas, the inner diameter r=0.8 to 4.4 of the luminous portion 7 and the thickness t=0.3 to of the luminous portion 7. Table 1 shows the measurement results X1.

TABLE 1

Results of Measurement X1

| sample No. | Pressure P of xenon (atm) | Inner diameter r of luminous portion (mm) | Thickness t of luminous portion (mm) | P/(r * t) | Luminous flux (lm) | Luminous efficiency (lm/W) | Endurance time (h) | Maximum value of luminance of arc (nt) | Determination |
|---|---|---|---|---|---|---|---|---|---|
| 1 | 8.0 | 4.0 | 0.8 | 2.5 | 2620 | 105 | **Not less than 3000 | 76 | D |
| 2 | 10.0 | 4.4 | 0.8 | 2.8 | 2680 | 107 | **Not less than 3000 | 74 | D |
| 3 | 10.0 | 4.0 | 1.0 | 2.5 | 2640 | 106 | **Not less than 3000 | 73 | D |
| 4 | 10.0 | 4.0 | 0.8 | 3.1 | 2780 | 111 | **Not less than 3000 | 83 | C |
| 5 | 10.0 | 3.8 | 0.8 | 3.3 | 2800 | 112 | **Not less than 3000 | 86 | C |
| 6 | 12.0 | 4.0 | 0.8 | 3.8 | 2860 | 114 | **Not less than 3000 | 87 | C |
| 7 | 10.0 | 4.0 | 0.6 | 4.2 | 2930 | 117 | **Not less than 3000 | 89 | C |
| 8 | 28.0 | 1.4 | 0.5 | 40.0 | 3590 | **144 | 2050 | **133 | C |
| 9 | 28.0 | 1.4 | 0.4 | 50.0 | 3580 | **143 | 1800 | **136 | C |
| 10 | 30.0 | 1.2 | 0.4 | 62.5 | 3590 | **144 | 1650 | **140 | C |
| 11 | 30.0 | 1.0 | 0.4 | 75.0 | 3610 | **144 | 1400 | **145 | C |
| 12 | 32.0 | 1.0 | 0.4 | 80.0 | 3600 | **144 | 1310 | **147 | E |
| 13 | 30.0 | 0.8 | 0.4 | 93.8 | 3620 | **145 | 1000 | **145 | E |
| 14 | 30.0 | 1.0 | 0.3 | 100.0 | — | — | 0 | — | E |

In the determination column of the measurement results X1, samples for which each of the luminous efficiency, the endurance time and the maximum value of the luminance were greatly varied from the first target values were determined to be D or E, and the other samples were determined to be C. Specifically, the sample Nos. 1 to No. 3 were determined to be D, the sample Nos. 4 to 11 were determined to be C and the sample Nos. 12 to 14 were determined to be E. In the sample Nos. 4 to 11, which were determined to be C, one parameter or two parameters of the luminous efficiency, the endurance time and the maximum value of the luminance attained the second target values and the residual two parameters or one parameter did not attain the first target value, however, the residual two parameters or one parameter was not greatly varied from the first target value.

Here, in sample No. 14, the luminous flux and the maximum value of the luminance could not be measured because cracks were generated in the ceramic luminous tube 5 immediately after the electric discharge lamp was turned on.

Next, in the range of the parameter used in the data of the measurement results X1, the determination C was obtained in the range except for the upper limit side and the lower limit side. Therefore, the range, in which the determination C was obtained, was reduced to the following range and the measurement was made.

The measurements were made in the ranges of the pressure P=8 to 26 of xenon gas, the inner diameter r=1.2 to 3.2 of the luminous portion 7 and the thickness t=0.4 to 0.8 of the luminous portion 7. These are shown on Table 2 by the measurement results Y1.

TABLE 2

Results of Measurement Y1

| sample No. | Pressure P of xenon (atm) | Inner diameter r of luminous portion (mm) | Thickness t of luminous portion (mm) | P/(r * t) | Luminous flux (lm) | Luminous efficiency (lm/W) | Endurance time (h) | Maximum value of luminance of arc (nt) | Determination |
|---|---|---|---|---|---|---|---|---|---|
| 101 | 8.0 | 3.0 | 0.7 | 3.8 | 2880 | 115 | **Not less than 3000 | 97 | C |
| 102 | 10.0 | 3.2 | 0.7 | 4.5 | 2990 | *120 | **Not less than 3000 | 94 | C |
| 103 | 10.0 | 3.0 | 0.8 | 4.2 | 2950 | 118 | **Not less than 3000 | 95 | C |
| 104 | 10.0 | 3.0 | 0.7 | 4.8 | 3020 | *121 | **Not less than 3000 | *100 | B |
| 105 | 12.0 | 3.0 | 0.7 | 5.7 | 3080 | *123 | **Not less than 3000 | *107 | B |
| 106 | 10.0 | 2.6 | 0.7 | 5.5 | 3070 | *123 | **Not less than 3000 | *107 | B |
| 107 | 10.0 | 3.0 | 0.5 | 6.7 | 3100 | *124 | **Not less than 3000 | *110 | B |
| 108 | 22.0 | 1.8 | 0.5 | 24.4 | 3480 | **139 | *2800 | **137 | B |
| 109 | 24.0 | 1.8 | 0.5 | 26.7 | 3510 | **140 | *2720 | **140 | B |
| 110 | 22.0 | 1.5 | 0.5 | 29.3 | 3550 | **142 | *2690 | **143 | B |
| 111 | 24.0 | 1.5 | 0.5 | 32.0 | 3560 | **142 | *2580 | **144 | B |
| 112 | 26.0 | 1.5 | 0.5 | 34.7 | 3570 | **143 | 2340 | **147 | C |
| 113 | 24.0 | 1.2 | 0.5 | 40.0 | 3580 | **143 | 2060 | **146 | C |
| 114 | 24.0 | 1.5 | 0.4 | 40.0 | 3600 | **144 | 2020 | **146 | C |

In the determination column of the measurement results Y1, data for which any one of the luminous efficiency, the endurance time and the maximum value of the luminance did not attain the first target value were determined to be C. Data for which each of the luminous efficiency, the endurance time and the maximum value of the luminance attained the first target values were determined to be B. Specifically, the sample Nos. 101 to No. 103 were determined to be C, the sample Nos. 104 to 111 were determined to be B and the sample Nos. 112 to 114 were determined to be C. In the sample Nos. 104 to 111, which were determined to be B, all of the parameters of the luminous efficiency, the endurance time and the maximum value of the luminance attained the first target values. However, at least one of the luminous efficiency, the endurance time and the maximum value of the luminance did not attain the second target value.

Finally, in the ranges of the parameter used in the data of the measurement results Y1, the determination B was obtained in the range except for the upper limit side and the lower limit side. Therefore, the range in which the determination B was obtained was reduced to the following range and the measurement was made.

The measurements were made in the ranges of the pressure P=12 to 24 of xenon gas, the inner diameter r=2.0 to 2.4 of the luminous portion 7 and the thickness t=0.4 to 0.7 of the luminous portion 7. These are shown on Table 3 by the measurement results Z1.

ceramic luminous tube 5 and t (mm) was a thickness of the luminous portion 7 of the ceramic luminous tube 5, in the range in which P/(r•t) was not less than 4.8 and not more than 32, the first target values could be attained in which the luminous efficiency was 120 (lm/W), the endurance time was 2500 (h) and the maximum value of the luminance was 100 (nt).

Accordingly, when the pressure P (atm) of xenon gas, the inner diameter r (mm) of the luminous portion 7 of the ceramic luminous tube 5 and the thickness t (mm) of the luminous portion 7 of the ceramic luminous tube 5 are set so that P/(r•t) can be not less than 4.8 and not more than 32, the luminous efficiency, the durability and the luminance can be enhanced by a decrease in the thermal stress due to the uniform heating of the ceramic luminous tube 5.

According to the results obtained in the first measurement, it is possible to attain the second target value in which the luminous efficiency is not less than 130 (lm/W), the endurance time is not less than 3000 (h) and the maximum value of the luminance is not less than 120 (nt), in the range in which P/(r•t) is not less than 10 and not more than 20.

Accordingly, when the pressure P (atm) of xenon gas, the inner diameter r (mm) of the luminous portion 7 of the ceramic tube 5 and the thickness t (mm) of the luminous portion 7 of the ceramic luminous tube 5 are set so that P/(r•t) is not less than 10 and not more than 20, the luminous efficiency, the durability and the luminance can be enhanced by

TABLE 3

Results of Measurement Z1

| sample No. | Pressure P of xenon (atm) | Inner diameter r of luminous portion (mm) | Thickness t of luminous portion (mm) | P/(r * t) | Luminous flux (lm) | Luminous efficiency (lm/W) | Endurance time (h) | Maximum value of luminance of arc (nt) | Determination |
|---|---|---|---|---|---|---|---|---|---|
| 201 | 12.0 | 2.2 | 0.6 | 9.1 | 3200 | *128 | **Not less than 3000 | *116 | B |
| 202 | 14.0 | 2.4 | 0.6 | 9.7 | 3270 | **131 | **Not less than 3000 | *113 | B |
| 203 | 14.0 | 2.2 | 0.7 | 9.1 | 3170 | *127 | **Not less than 3000 | *110 | B |
| 204 | 14.0 | 2.2 | 0.6 | 10.6 | 3280 | **131 | **Not less than 3000 | **126 | A |
| 205 | 16.0 | 2.2 | 0.6 | 12.1 | 3310 | **132 | **Not less than 3000 | **128 | A |
| 206 | 16.0 | 2.2 | 0.5 | 14.5 | 3340 | **134 | **Not less than 3000 | **130 | A |
| 207 | 18.0 | 2.2 | 0.5 | 16.4 | 3380 | **135 | **Not less than 3000 | **133 | A |
| 208 | 20.0 | 2.2 | 0.5 | 18.2 | 3400 | **136 | **Not less than 3000 | **136 | A |
| 209 | 22.0 | 2.2 | 0.5 | 20.0 | 3420 | **137 | **Not less than 3000 | **138 | A |
| 210 | 24.0 | 2.2 | 0.5 | 21.8 | 3460 | **138 | *2880 | **140 | B |
| 211 | 22.0 | 2.0 | 0.5 | 22.0 | 3450 | **138 | *2790 | **139 | B |
| 212 | 22.0 | 2.2 | 0.4 | 25.0 | 3470 | **139 | *2830 | **139 | B |

In the determination column of the measurement results Z1, data for which any one of the luminous efficiency, the endurance time and the maximum value of the luminance did not attain the second target value was determined to be B. Data for which all of the luminous efficiency, the endurance time and the maximum value of the luminance attained the second target values were determined to be A. Specifically, the sample Nos. 201 to No. 203 were determined to be B, the sample Nos. 204 to 209 were determined to be A and the sample Nos. 210 to 212 were determined to be B.

As described above, according to the measurement results obtained in the first measurement, when P (atm) was a pressure of xenon gas charged into the ceramic luminous tube 5, r (mm) was an inner diameter of the luminous portion 7 of the a decrease in the thermal stress because the uniform heating of the ceramic luminous tube 5 is uniformly heated.

Next, the second measurement will be explained below, referring to Tables 4 to 6.

In the second measurement, R•P/r was calculated where P denotes the pressure P (atm) of xenon gas charged into the ceramic luminous tube 5, r denotes the inner diameter r (mm) shown in FIG. 1 of the luminous portion 7 of the ceramic luminous tube 5 and R denotes the coefficient of thermal conductivity R (W/mK) of the ceramic luminous tube 5. For the respective values, the luminous flux (lm) emergent from the luminous portion 7 and the endurance time (h) of the ceramic luminous tube 5 were measured. From the measured luminous flux, the luminous efficiency (lm/W) was calculated.

The luminous efficiency was calculated by "Luminous flux/Electric power". In this second measurement, too, the electric power is 25 W (±5 W) used for the electric discharge lamp 1. Accordingly, the luminous efficiency was calculated by "Luminous flux/25".

In the second measurement, in the same manner as that of the first measurement, the first target values were set as follows: the luminance efficiency was not less than 120 (1 m/W) and the endurance time was not less than 2500 (h). The second target values were set as follows: the luminance efficiency was not less than 130 (1 m/W) and the endurance time was not less than 3000 (h).

In Tables 4 to 6, values with the reference mark "*" are values that attained the first target values and values with the reference mark "**" are values that attained the second target values.

As in the first measurement, a determination was made when the results obtained in the second measurement were compared with the first and the second target values. The determination was made according five stages A, B, C, D and E, with A being the best and E being the worst.

The second measurements were made in the ranges of the pressure P=8 to 32 of xenon gas, the inner diameter r=0.8 to 4.2 of the luminous portion 7 and the coefficient of thermal conductivity R=5 to 80 of the ceramic luminous tube 5. These are shown on Table 4 by the measurement results X2.

TABLE 4

Results of Measurement X2

| sample No. | Pressure P of xenon (atm) | Inner diameter r of luminous portion (mm) | Coefficient of thermal conductivity R (W/mk) | R * P/r | Luminous flux (lm) | Luminous efficiency (lm/W) | Endurance time (h) | Determination |
|---|---|---|---|---|---|---|---|---|
| 301 | 10.0 | 4.0 | 5 | 12.5 | 2650 | 106 | **Not less than 3000 | D |
| 302 | 8.0 | 4.0 | 10 | 20.0 | 2500 | 100 | **Not less than 3000 | D |
| 303 | 10.0 | 4.2 | 10 | 23.8 | 2730 | 109 | **Not less than 3000 | D |
| 304 | 10.0 | 4.0 | 10 | 25.0 | 2870 | 115 | **Not less than 3000 | C |
| 305 | 10.0 | 3.8 | 10 | 26.3 | 2890 | 116 | **Not less than 3000 | C |
| 306 | 10.0 | 4.0 | 15 | 37.5 | 2920 | 117 | **Not less than 3000 | C |
| 307 | 12.0 | 4.0 | 15 | 45.0 | 2950 | 118 | **Not less than 3000 | C |
| 308 | 28.0 | 1.4 | 50 | 1000.0 | 3650 | **146 | 1940 | C |
| 309 | 28.0 | 1.4 | 60 | 1200.0 | 3660 | **146 | 1800 | C |
| 310 | 30.0 | 1.2 | 60 | 1500.0 | 3660 | **146 | 1690 | C |
| 311 | 30.0 | 1.0 | 60 | 1800.0 | 3650 | **146 | 1500 | C |
| 312 | 32.0 | 1.0 | 60 | 1920.0 | 3680 | **147 | 1300 | E |
| 313 | 30.0 | 1.0 | 80 | 2400.0 | 3660 | **146 | 980 | E |
| 314 | 30.0 | 0.8 | 60 | 2250.0 | 3690 | **148 | 1010 | E |

In the measurement results X2, data for samples which each of the luminous efficiency and the endurance time were greatly varied from the first target values, were determined to be D or E. Other samples were determined to be C. Specifically, the sample Nos. 301 to No. 303 were determined to be D, the sample Nos. 304 to 311 were determined to be C and the sample Nos. 312 to 314 were determined to be E. In the sample Nos. 304 to 311, which were determined to be C, one of the luminous efficiency and the endurance time attained the second target values and the residual parameter did not attain the first target value. However, the residual parameter was not greatly varied from the first target value.

Next, in the range of the parameter used in the data of the measurement results X2, the determination C was obtained in the range except for the upper limit side and the lower limit side. Therefore, the range, in which the determination C was obtained, was reduced to the following range and the measurement was made.

The measurements were made in the ranges of the pressure P=8 to 26 of xenon gas, the inner diameter r=1.2 to 3.2 of the luminous portion 7 and the coefficient of thermal conductivity R=10 to 50 of the ceramic luminous tube 5. These are shown on Table 5 by the measurement results Y2.

TABLE 5

Results of Measurement Y2

| sample No. | Pressure P of xenon (atm) | Inner diameter r of luminous portion (mm) | Coefficient of thermal conductivity R (W/mk) | R * P/r | Luminous flux (lm) | Luminous efficiency (lm/W) | Endurance time (h) | Determination |
|---|---|---|---|---|---|---|---|---|
| 401 | 10.0 | 3.0 | 10 | 33.3 | 2840 | 114 | **Not less than 3000 | C |
| 402 | 8.0 | 3.0 | 15 | 40.0 | 2870 | 115 | **Not less than 3000 | C |
| 403 | 10.0 | 3.2 | 15 | 46.9 | 2940 | 118 | **Not less than 3000 | C |
| 404 | 10.0 | 3.0 | 15 | 50.0 | 2950 | 118 | **Not less than 3000 | C |
| 405 | 12.0 | 3.0 | 15 | 60.0 | 2990 | *120 | **Not less than 3000 | B |
| 406 | 10.0 | 2.6 | 20 | 76.9 | 3050 | *122 | **Not less than 3000 | B |
| 407 | 10.0 | 3.0 | 20 | 66.7 | 3020 | *121 | **Not less than 3000 | B |
| 408 | 22.0 | 1.8 | 34 | 415.6 | 3460 | **138 | *2780 | B |
| 409 | 24.0 | 1.8 | 34 | 453.3 | 3500 | **140 | *2690 | B |
| 410 | 22.0 | 1.5 | 34 | 498.7 | 3540 | **142 | *2600 | B |
| 411 | 24.0 | 1.5 | 40 | 640.0 | 3590 | **144 | *2530 | B |
| 412 | 26.0 | 1.5 | 40 | 693.3 | 3620 | **145 | 2300 | C |
| 413 | 24.0 | 1.5 | 50 | 800.0 | 3640 | **146 | 2190 | C |
| 414 | 24.0 | 1.2 | 40 | 800.0 | 3630 | **145 | 2150 | C |

In the determination column of the measurement results Y2, data for which any of the luminous efficiency and the endurance time did not attain the first target value, were determined to be C. Data for which each of the luminous efficiency and the endurance time attained the first target values, were determined to be B. Specifically, the sample Nos. 401 to No. 404 were determined to be C, the sample Nos. 405 to 411 were determined to be B and the sample Nos. 412 to 414 were determined to be C. In the sample Nos. 405 to 411, which were determined to be B, all of the parameters of the luminous efficiency and the endurance time attained the first target values. However, neither of the luminous efficiency and the endurance time attained the second target value.

Finally, in the ranges of the parameter used in the data of the measurement results Y2, the determination B was obtained in the range except for the upper and the lower limit sides. Therefore, the range, in which the determination B was obtained, was reduced to the following range and the measurement was made.

The measurements were made in the ranges of the pressure P=12 to 24 of xenon gas, the inner diameter r=2.0 to 2.4 of the luminous portion 7 and the coefficient of thermal conductivity R=25 to 45 of the ceramic luminous tube 5. These are shown on Table 6 by the measurement results Z2. ity R=25 to 45 of the ceramic luminous tube 5. These are shown on Table 6 by the measurement results Z2.

TABLE 6

Results of Measurement Z2

| sample No. | Pressure P of xenon (atm) | Inner diameter r of luminous portion (mm) | Coefficient of thermal conductivity R (W/mk) | R * P/r | Luminous flux (lm) | Luminous efficiency (lm/W) | Endurance time (h) | Determination |
|---|---|---|---|---|---|---|---|---|
| 501 | 14.0 | 2.2 | 25 | 159.1 | 3220 | *129 | **Not less than 3000 | B |
| 502 | 12.0 | 2.2 | 30 | 163.6 | 3220 | *129 | **Not less than 3000 | B |
| 503 | 14.0 | 2.4 | 30 | 175.0 | 3270 | **131 | **Not less than 3000 | A |
| 504 | 14.0 | 2.2 | 30 | 190.9 | 3300 | **132 | **Not less than 3000 | A |
| 505 | 16.0 | 2.2 | 30 | 218.2 | 3330 | **133 | **Not less than 3000 | A |
| 506 | 16.0 | 2.2 | 34 | 247.3 | 3370 | **135 | **Not less than 3000 | A |
| 507 | 18.0 | 2.2 | 34 | 278.2 | 3400 | **136 | **Not less than 3000 | A |
| 508 | 20.0 | 2.2 | 34 | 309.1 | 3420 | **137 | **Not less than 3001 | A |
| 509 | 22.0 | 2.2 | 40 | 400.0 | 3460 | **138 | **Not less than 3002 | A |
| 510 | 24.0 | 2.2 | 40 | 436.4 | 3510 | **140 | *2850 | B |
| 511 | 22.0 | 2.0 | 40 | 440.0 | 3500 | **140 | *2830 | B |
| 512 | 22.0 | 2.2 | 45 | 450.0 | 3530 | **141 | *2810 | B |

In the determination column of the measurement results Z2, data for which any one of the luminous efficiency and the endurance time did not attain the second target value, were determined to be B. Data for which each of the luminous efficiency and the endurance time attained the second target values, were determined to be A. Specifically, the sample Nos. 601 and No. 602 were determined to be B, the sample Nos. 603 to 609 were determined to be A and the sample Nos. 610 to 612 were determined to be B.

As described above, according to the measurement results obtained in the second measurement, when P (atm) was a pressure of xenon gas filled into the ceramic luminous tube 5, r (mm) was an inner diameter of the luminous portion 7 of the ceramic luminous tube 5 and R(W/(m•K)) was a coefficient of thermal conductivity of ceramic tube 5, it was possible to attain the first target value in which the luminous efficiency was not less than 120 (lm/W) and the endurance time was not less than 2500 (h) in the range in which R•P/r was not less than 60 and not more than 640.

Accordingly, when the pressure P (atm) of xenon gas, the inner diameter r (mm) of the luminous portion 7 of the ceramic luminous tube 5 and the coefficient of thermal conductivity R(W/m•K) of the ceramic luminous tube 5 are set so that R•P/r can be not less than 60 and not more than 640, the luminous efficiency and the durability of the ceramic luminous tube 5 can be enhanced by reducing the thermal stress due to the uniform heating of the ceramic luminous tube 5.

According to the results obtained in the second measurement, it was possible to attain the second target value in which the luminous efficiency was not less than 130 (lm/W) and the endurance time was not less than 3000 (h) in the range in which R•P/r was not less than 175 and not more than 400.

Accordingly, when the pressure P (atm) of xenon gas, the inner diameter r (mm) of the luminous portion 7 of the ceramic luminous tube 5 and the coefficient of thermal conductivity R(W/m•K) of the ceramic luminous tube 5 are set so that R•P/r is not less than 175 and not more than 400, the luminous efficiency and the durability of the ceramic luminous tube 5 can be more enhanced by reducing the thermal stress due to the uniform heating of the ceramic luminous tube 5.

The shape and structure of each portion shown in the exemplary embodiment of the present invention described above are just examples for realizing the present invention. It should be noted that the technical range of the present invention is not limited by the above specific examples.

According to exemplary embodiments of the present invention, the durability and the luminance efficiency of the electric discharge lamp can be enhanced due to reduced thermal stress by uniform heating of the ceramic luminous tube.

Further, when P/(r•t) is set to be not less than 10 and not more than 20, the durability and the luminous efficiency of the ceramic luminous tube can be more enhanced.

Similarly, when R•P/r is set to be not less than 175 and not more than 400, the durability and the luminous efficiency of the ceramic luminous tube can be more enhanced.

While the invention has been described in connection with the exemplary embodiments, it will be obvious to those skilled in the art that various changes and modifications may be made therein without departing from the present invention, and it is aimed, therefore, to cover in the appended claims all such changes and modifications as fall within the true spirit and scope of the present invention.

What is claimed is:

1. An electric discharge lamp comprising:

a ceramic luminous tube comprising:

a luminous portion filled with xenon gas and emitting light; and two tube portions connected respectively to longitudinal end portions of the luminous portion, an outer diameter of each of the tube portions being smaller than an outer diameter of the luminous portion;

two electrodes held by the tube portions, respectively; and a glass outer tube which accommodates the ceramic luminous tube and the two electrodes therein, wherein a value of P/(r•t) is not less than 4.8 and not more than 32, in which P (atm) denotes a pressure of the xenon gas filled in the luminous portion, r (mm) denotes an inner diameter of the luminous portion, and t (mm) denotes wall thickness of the luminous portion.

2. The electric discharge lamp according to claim 1, wherein the value of P/(r•t) is not less than 10 and not more than 20.

* * * * *